US005123637A

United States Patent [19]

Musaka

[11] Patent Number: 5,123,637

[45] Date of Patent: Jun. 23, 1992

[54] PAPER FEEDING DEVICE WITH AN ELEVATABLE TRAY FOR A COPIER

[75] Inventor: Masateru Musaka, Tokyo, Japan

[73] Assignee: Ricoh Company, Ltd., Tokyo, Japan

[21] Appl. No.: 504,882

[22] Filed: Apr. 5, 1990

[30] Foreign Application Priority Data

Apr. 6, 1989 [JP] Japan ..... 1-87473

[51] Int. Cl.[5] ..... B65H 3/06

[52] U.S. Cl. ..... 271/117; 271/126; 271/157

[58] Field of Search ..... 271/110, 111, 117, 126, 271/152, 155, 157

[56] References Cited

U.S. PATENT DOCUMENTS 4,801,135 1/1989 Povio ..... 271/157 X 4,852,869 8/1989 Watanabe ..... 271/157 X

FOREIGN PATENT DOCUMENTS 3017329 11/1980 Fed. Rep. of Germany .

1282910 7/1972 United Kingdom .

*Primary Examiner*—Richard A. Schacher

*Attorney, Agent, or Firm*—Oblon, Spivak, McClelland, Maier & Neustadt

[57] ABSTRACT

A device for use with a copier for sequentially feeding, one at a time, paper sheets which are stacked on an elevatable tray. When a paper jam or similar error has occurred in the vicinity of the tray, the device allows the operator to restore the copier to a normal condition and resume the paper feeding operation within a short period of time.

2 Claims, 10 Drawing Sheets

PAPER FEEDING DEVICE WITH AN ELEVATABLE TRAY FOR A COPIER

BACKGROUND OF THE INVENTION

The present invention relates to a device for use with a copier for sequentially feeding, one at a time, a number of paper sheets which are stacked on a tray and, more particularly, to a paper feeding device having an elevatable tray.

In an electrophotographic copier, for example, a paper feeding device is constructed to feed paper sheets from a cassette or a tray one at a time. A prerequisite with such a manner of paper feed is that the top of a paper stack loaded on the tray be constantly pressed against a feed roller. It has been customary, therefore, to provide the entire tray or a part of the tray with a movable structure and to apply a mechanical force to the tray to thereby maintain the top of the paper stack in pressing contact with the feed roller. A mass paper feeding device is available with a modern copier so that a great amount of paper sheets, e.g., 1,000, 2,000 or 3,000 paper sheets may be fed at a time. Such a mass paper feeding device has to be movable up and down over a substantial stroke and is, therefore, driven up and down by a drive mechanism including an electric motor.

When the mass paper feeding device is used, its tray is held in an upper limit position with the top of the paper stack being pressed against the feed roller. As a paper jam or similar error occurs in the vicinity of a paper feed opening which is formed in the copier, the operator is required to see a condition of the paper feed opening and, if a jamming sheet exists, remove it. However, since a great number of paper sheets are stacked on the tray and conceals the paper feed opening, the operator cannot deal with the error without actuating the drive mechanism for lowering the tray. Especially, when the amount of paper sheets remaining on the tray is relatively small, it takes a substantial period of time to raise or lower the tray due to the long stroke of the tray. The operator, therefore, has to wait long until the top of the paper stack contacts the feed roller for feeding the paper sheets, after the operator has lowered the tray, removed a jamming sheet, and entered a tray elevation command. That is, when an error such as a paper jam occurs in the mass paper feeding device, an extremely long period of time is needed for the device to restore its normal condition and allow a copying operation to be resumed.

SUMMARY OF THE INVENTION

It is therefore an object of the present invention to provide a paper feeding device with an elevatable tray for a copier which, when a paper jam or similar error is detected in the vicinity of the tray, reduces the period of time necessary for the error to be removed and the copying operation to be resumed.

It is another object of the present invention to provide a generally improved paper feeding device with an elevatable tray for a copier.

A device for sequentially feeding a number of paper sheets stacked on an elevatable tray one by one through a paper feed opening of the present invention comprises a drive mechanism for driving the tray up and down, a paper feeding member for sequentially feeding the paper sheets stacked on the tray through the paper feed opening, an upper limit position sensor for sensing an upper limit position of the tray corresponding to a position at which the paper sheets on the tray are pressed by the paper feeding member, a lower limit position sensor for sensing a lower limit position of the tray, and a controller for controlling, when an error is detected in the vicinity of the paper feed opening while the tray is in the upper limit position, the drive mechanism to lower the tray by a predetermined stroke until the tray reaches a position intervening between the upper and lower limit positions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
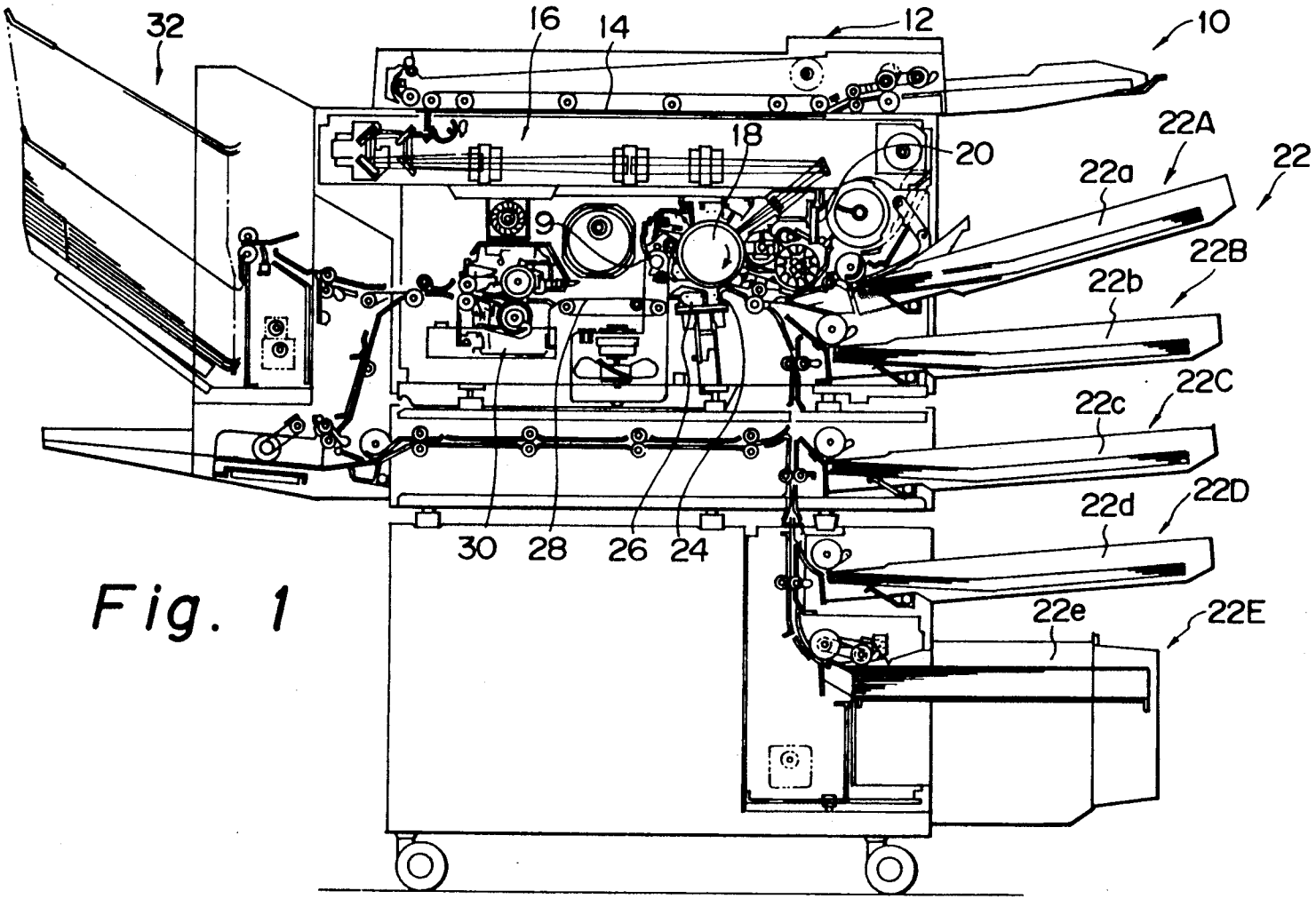
FIG. 1 is a section of a copier to which a paper feeding device of the present invention is applicable.

Referring to FIG. 1 of the drawings, a copier to which a paper feeding device embodying the present invention is applicable is shown and generally designated by the reference numeral 10. As shown, a document is fed to and laid on a glass platen 14 either automatically by an automatic document feeder (ADF) 12 or manually by the operator. Optics 16 is disposed below the glass platen 14 to scan the document laid on the glass platen 14. A reflection from the document, i.e., a light image is focused onto a photoconductive drum 18 with the result that a latent image representative of the document is electrostatically formed on the drum 18. The latent image is developed by a toner while it moves through a developing unit 20. The developed image or toner image is brought into register with a paper sheet which is fed from a paper feeding section, generally 22, toward the drum 18. A transfer charger 24 transfers the toner image from the drum 18 to the paper sheet. The paper sheet carrying the toner image thereon is separated from the drum 18 by a separation charger 26 and then transported by a belt 28 to a fixing unit 30. The paper sheet coming out of the fixing unit 30 is driven toward a sorter 32. The sorter 32 has a plurality of bins to which such paper sheets may be distributed.

Since the present invention does not pertain to the construction of the copier 10, any further description of the copier 10 will be avoided for simplicity. A preferred embodiment of the paper feeding device in accordance with the present invention will be described hereinafter.

In the illustrative embodiment, the paper feeding section 22 has five paper feeding devices 22A, 22B, 22C, 22D and 22E. The upper four devices 22A, 22B, 22C and 22D are provided with paper cassettes 22*a*, 22*b*, 22*c* and 22*d*, respectively. The paper cassettes 22*a* to 22*d* each is inserted into the copier from the outside and is removable from its associated paper feed opening. The lowermost paper feeding device 22E is provided with a paper tray unit 22*e*. It should be noted, however, that the paper tray unit 22*e* may be mounted on any one of the devices 22A to 22E, and that any one of the paper cassettes 22*a* to 22*d* may be mounted on the lowermost device 22E in place of the paper tray unit 22*e*.

Figure 2:
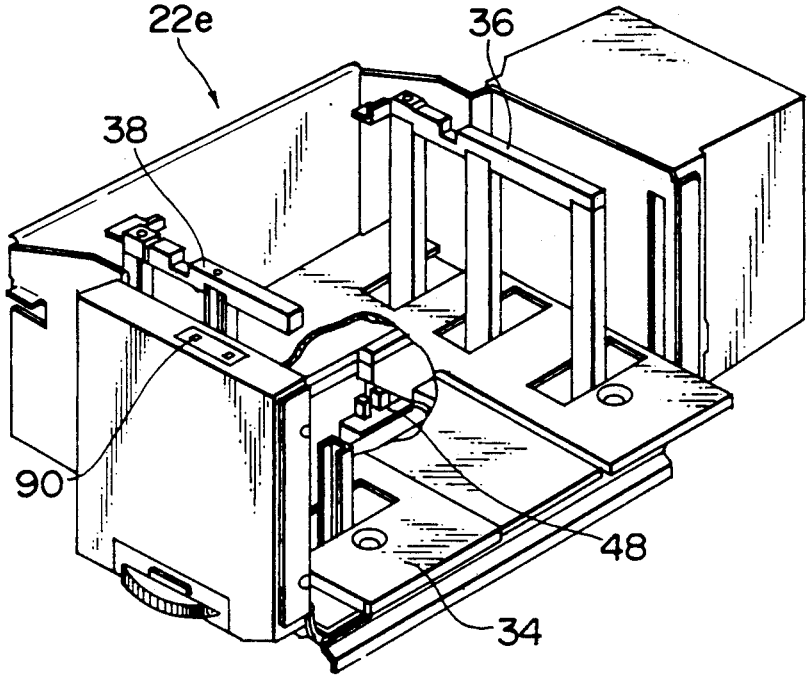
FIGS. 2 and 3 are fragmentary perspective views of a paper feeding device embodying the present invention.

Referring to FIG. 2, the paper tray unit 22*e* has a tray 34 and a pair of side guides 36 and 38 thereinside. The tray 34 may be loaded with about 1,000 paper sheets at maximum. The top of such a stack of paper sheets loaded on the tray 34 is maintained at a predetermined level automatically by a drive mechanism 40 shown in FIG. 3. Specifically, the drive mechanism 40 has an electric motor 42 and automatically adjusts the position, or height, of the tray 34. The tray 34 is rigidly mounted on a pair of support bars 44 and 46, FIG. 3, which are driven up and down by the drive mechanism 40. A transmission type optical sensor, or lower limit sensor, is responsive to the lower limit position of the tray 34.

Figure 4:
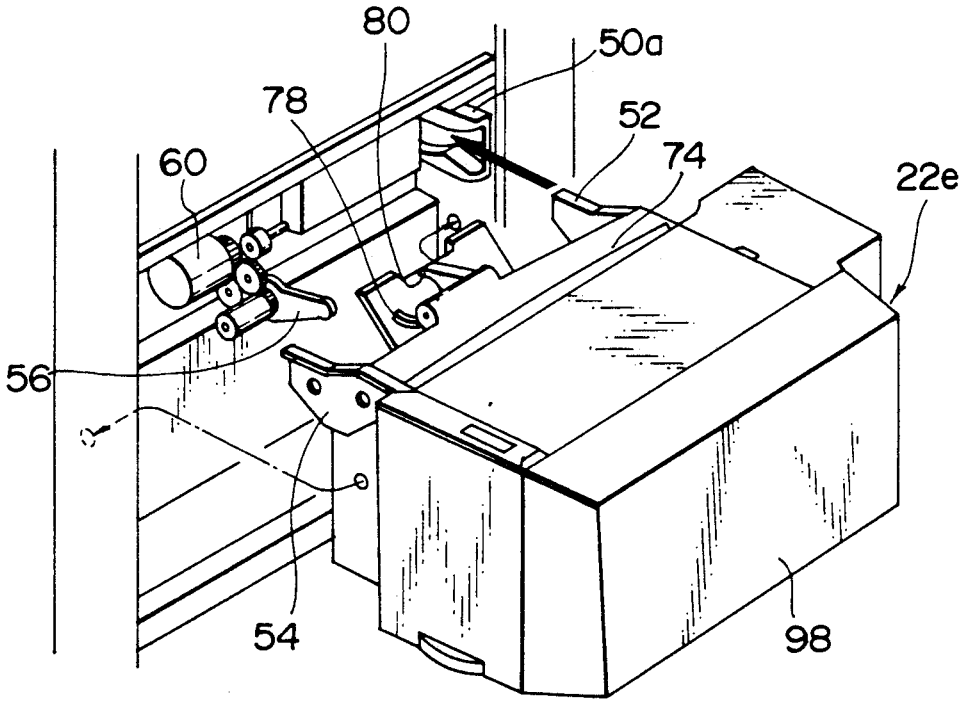
FIG. 4 is an external view of the paper feeding device shown in FIGS. 2 and 3.
Figure 5:
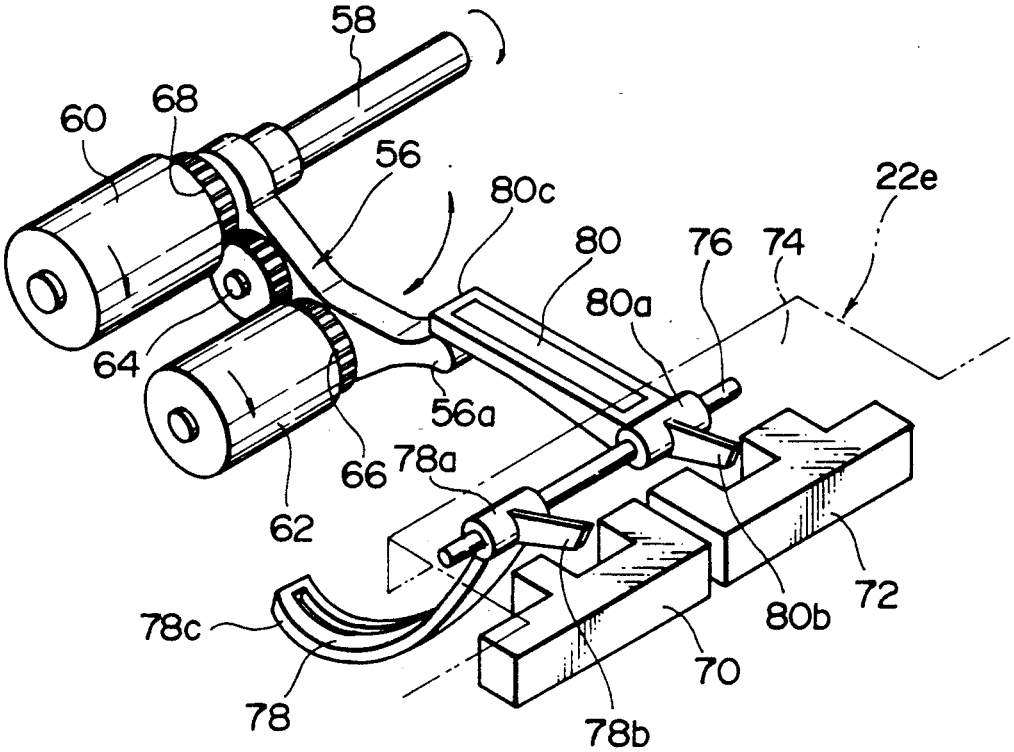
FIG. 5 is a fragmentary view showing the paper feeding device of FIG. 4 in an enlarged scale.

FIG. 4 indicates the paper tray unit 22*e* and an arrangement built in the lowermost paper feed opening in which the unit 22*e* is to be received. As shown, a guide member 50*a* is located in and at the right-hand side of the paper feed opening for the purpose of guiding and supporting the paper tray unit 22*e* or any one of the paper cassettes. A similar guide member (invisible) is located in and at the left-hand side of the paper feed opening. Support members 52 and 54 extend out from opposite sides of the upper front end of the paper tray unit 22*e* in such a manner as to mate with the guide members 50*a* and 50*b*, respectively. A pick-up roller assembly 56 is mounted in a front part of the paper tray unit 22*e*. Specifically, as shown in FIG. 5, the pick-up roller 56 and a feed roller 60 are mounted on a drive shaft 58. While the feed roller 60 is fixed to the drive shaft 58, the pick-up roller assembly 56 is simply supported by the drive shaft 58 and rotatable about the latter. When any one of the paper cassettes is to be set in the paper feed opening, the pick-up roller assembly 56 will be removed from the drive shaft 58. The pick-up roller assembly 56 has a pick-up roller 62 and a gear 64 each being rotatable. A gear 66 is fixed to the pick-up roller 62 coaxially to the latter and is held in mesh with the gear 64. Likewise, a gear 68 is fixed to the feed roller 60 coaxially with the latter and is held in mesh with the gear 64. In this configuration, as the drive shaft 58 is rotated, it rotates the feed roller 60 which in turn rotates the pick-up roller 62 via the gears 68, 64 and 66.

As shown in FIG. 5, two optical sensors 70 and 72 are incorporated in the paper tray unit 22*e* and located in the vicinity of the pick-up roller assembly 56. The sensors 70 and 72 each is implemented by a light emitting diode and a phototransistor which face each other. The sensors 70 and 72 serve as a paper end sensor and an upper limit sensor, respectively. The paper tray unit 22*e* has a frame 74 to which a shaft 76 is affixed in front of the sensors 70 and 72. Feelers 78 and 80 are rotatably mounted on the stationary shaft 76. The feeler 78 has a hub 78*a* supported by the shaft 76, a light intercepting piece 78*b* extending toward the sensor 70, and an arcuate sensing piece 78*c* extending downward and having a substantial length. Disposed below the sensing piece 78*c* is a paper sheet or paper sheets stacked on the tray 34. When even a single paper sheet is present on the tray 34, it will raise the sensing piece 78*c* to cause the light intercepting piece 78*b* to enter the optical path of the sensor 70. When no paper sheets exist on the tray 34, the sensing piece 78*c* will be lowered to position the light intercepting piece 78*b* outside of the sensor 70. Hence, the output signal of the sensor 70 has either one of two levels depending on the presence/absence of paper sheets on the tray 34. The other feeler 80 has a hub 80*a* supported by the shaft 76, a light intercepting piece 80*b* extending toward the sensor 72, and an elongate sensing piece 80*c* extending toward the pick-up roller assembly 56.

Figure 6:
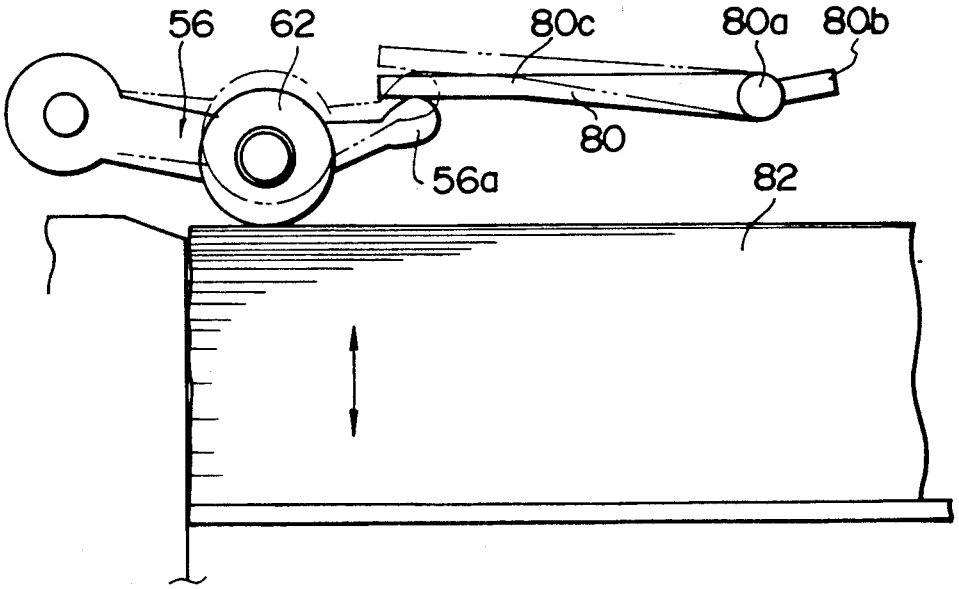
FIG. 6 is a side elevation showing an arrangement of the paper feeding device of FIG. 4 which is located in the vicinity of a paper feed opening.

As shown in FIG. 6, paper sheets 82 are stacked on the tray 34 below the pick-up roller 62. The pick-up roller 62 rests on the top of the paper stack 82 due to gravity. Hence, as the paper stack 62 is raised, it in turn forces the pick-up roller 62 and, therefore, the sensing piece 80*c* upward. More specifically, the light intercepting piece 80*b* of the feeler 80 remains in the optical path of the sensor 72 so long as the top of the paper stack 82 is positioned at a lower level than a certain reference level. However, when the top of the paper stack 82 is raised above the reference level, the light intercepting piece 80*b* is brought out of the optical path of the sensor 72. Hence, the output signal of the sensor 72 has either one of two levels depending on the level of the top of the paper stack 82.

Figure 3:
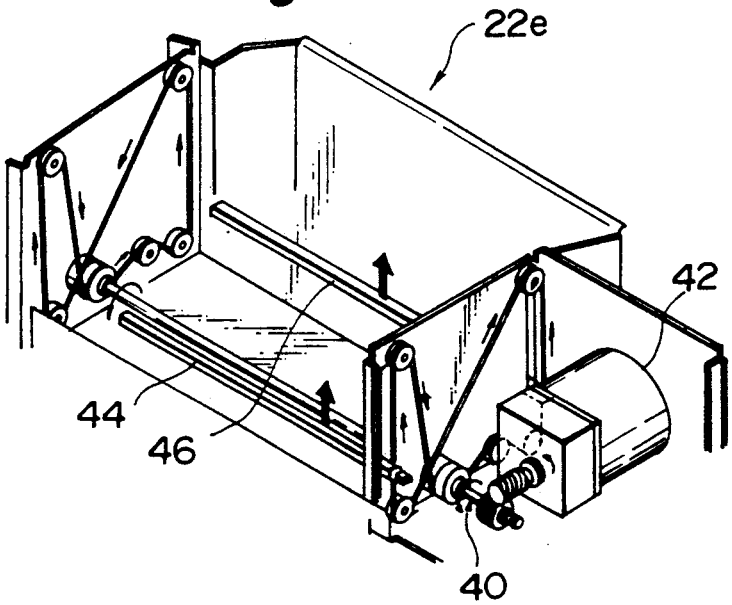

When the top of the paper stack 82 is located below the reference level as sensed by the sensor 72, the motor 42, FIG. 3, is energized to elevate the tray 34 and, therefore, the paper stack 82. As the top of the paper stack 82 reaches the reference level, the sensor 72 senses it with the result that the motor 42 is deenergized. While the pick-up roller 62 and feed roller 60 sequentially feed the paper sheets 82, the uppermost paper sheet first, the top of the paper stack 82 is lowered below the reference level. Then, the motor 42 is driven again in response to the output of the sensor 72, whereby the paper stack 82 is raised. The motor 42 is deenergized as soon as the paper stack 82 is restored to the reference level. In this manner, the top of the paper stack 82 is held at the predetermined level all the time.

Figure 7:
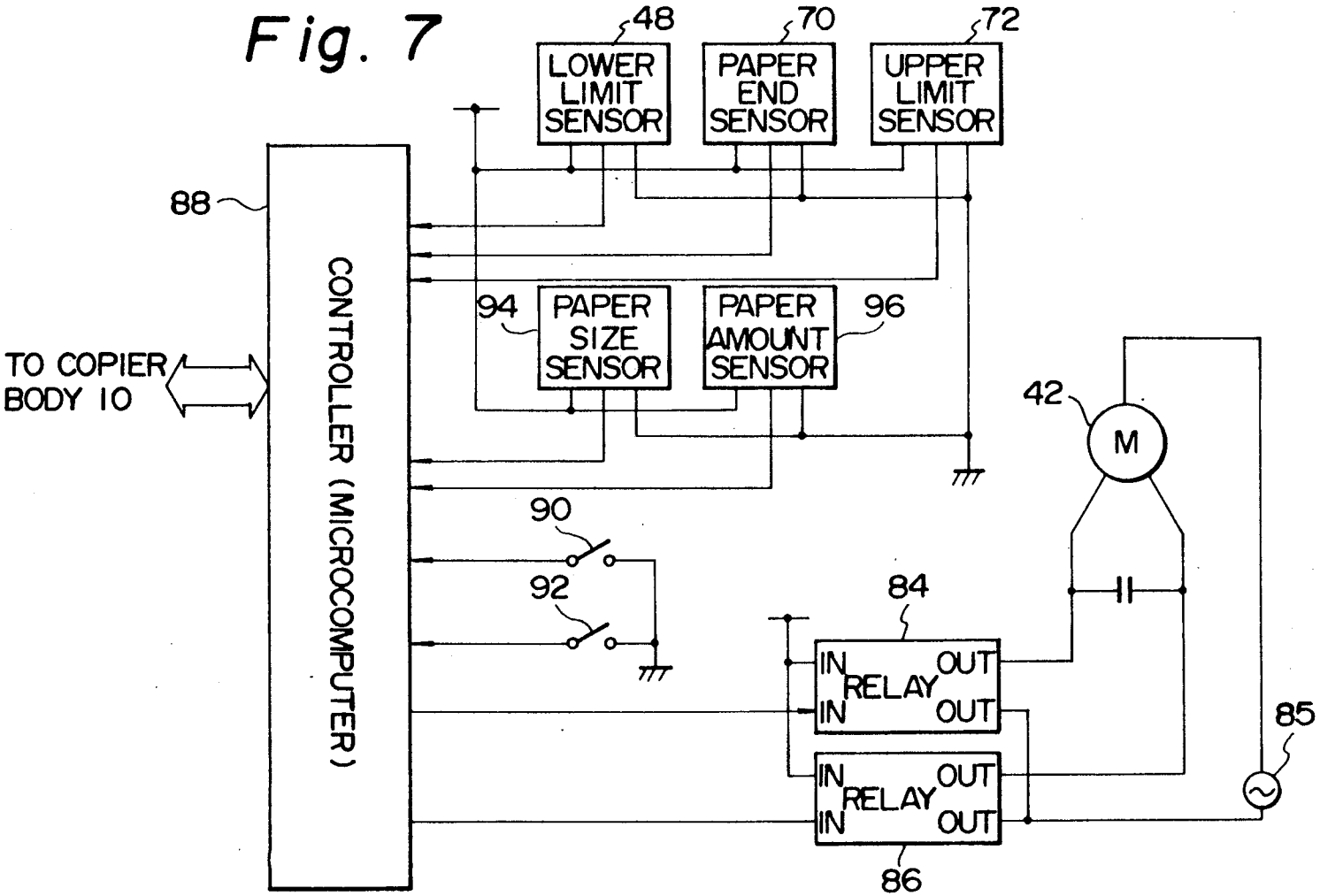
FIG. 7 is a schematic block diagram showing control circuitry of the paper feeding device.

Referring to FIG. 7, control circuitry for controlling the operations of the paper feeding section 22 will be described. As shown, the motor 42 for driving the tray 34 has terminals which are individually interconnected to output terminals of two solid-state relays 84 and 86 and an AC power source 85. The AC power source 85 applies an AC source voltage (100 volts) to the motor 42. The solid-state relays 84 and 86 are selectively energized to switch over the rotating direction of the motor 42, whereby the tray 34 is raised or lowered. A controller 88 is implemented as a microcomputer and interconnected to input terminals of the relays 84 and 86. The lower limit sensor 48, paper end sensor 70 and upper limit sensor 72 are interconnected to input terminals of the controller 88. Interconnected to other input terminals of the controller 88 are a paper size sensor 94 responsive to the size of paper sheets stacked on the tray 34, and a paper amount sensor responsive to the amount of paper sheets remaining on the tray 34. A key switch 90 (see also FIG. 2) is mounted on the upper end of the paper feeding section 22 and is manipulated by the operator as needed. A door switch 92 is responsive to a position of a door 98, FIG. 4, which is openably mounted on the outer end of the paper feeding device 22.

The controller 88 is interconnected to a system controller, not shown, of the copier body by a communication line to interchange various kinds of information with the latter. For example, the controller 88 delivers information indicative of whether or not paper sheets can be fed, i.e., whether or not the tray 34 is in the upper limit position, while the system controller feeds information indicative of whether or not a paper jam has occurred in the vicinity of the paper feed opening.

Figure 8:
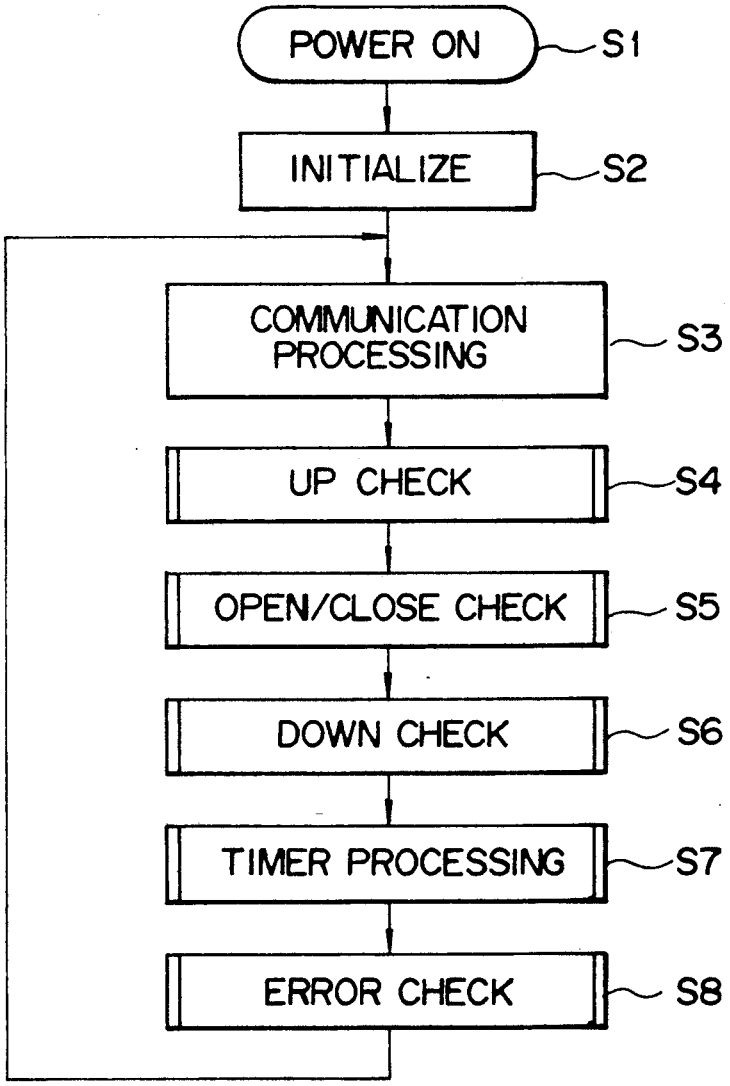
FIGS. 8 to 13 are flowcharts demonstrating the operation of the control circuitry shown in FIG. 7.

Referring to FIGS. 8 to 13, the operation of the controller 88 will be described. FIG. 8 demonstrates a main routine, while FIGS. 9 to 13 show individual subroutines included in the main routine in detail. In the figures, there appear a flag FTIM showing that the tray 34 has been lowered by the manipulation of the key switch 90, a flag FPEND showing that the tray 34 has been lowered due to a paper end condition, a flag FUPM for determining whether or not a predetermined period of time has expired after the lowering of the tray 34 caused through the key switch 90, a timer counter TCNT, and a counter JCNT which will be used in the event of a paper jam.

As shown in FIG. 8, when the power source is turned on (step S1), initialization is executed (Step S2). This is followed by an interative processing loop consisting of communication processing (step S3), up check (step S4), open/close check (step S5), down check (step S6), timer processing (step S7), and error check (step S8). In the communication processing step S3, the controller 88 interchanges various kind of information with the system controller of the copier 10.

Figure 9:
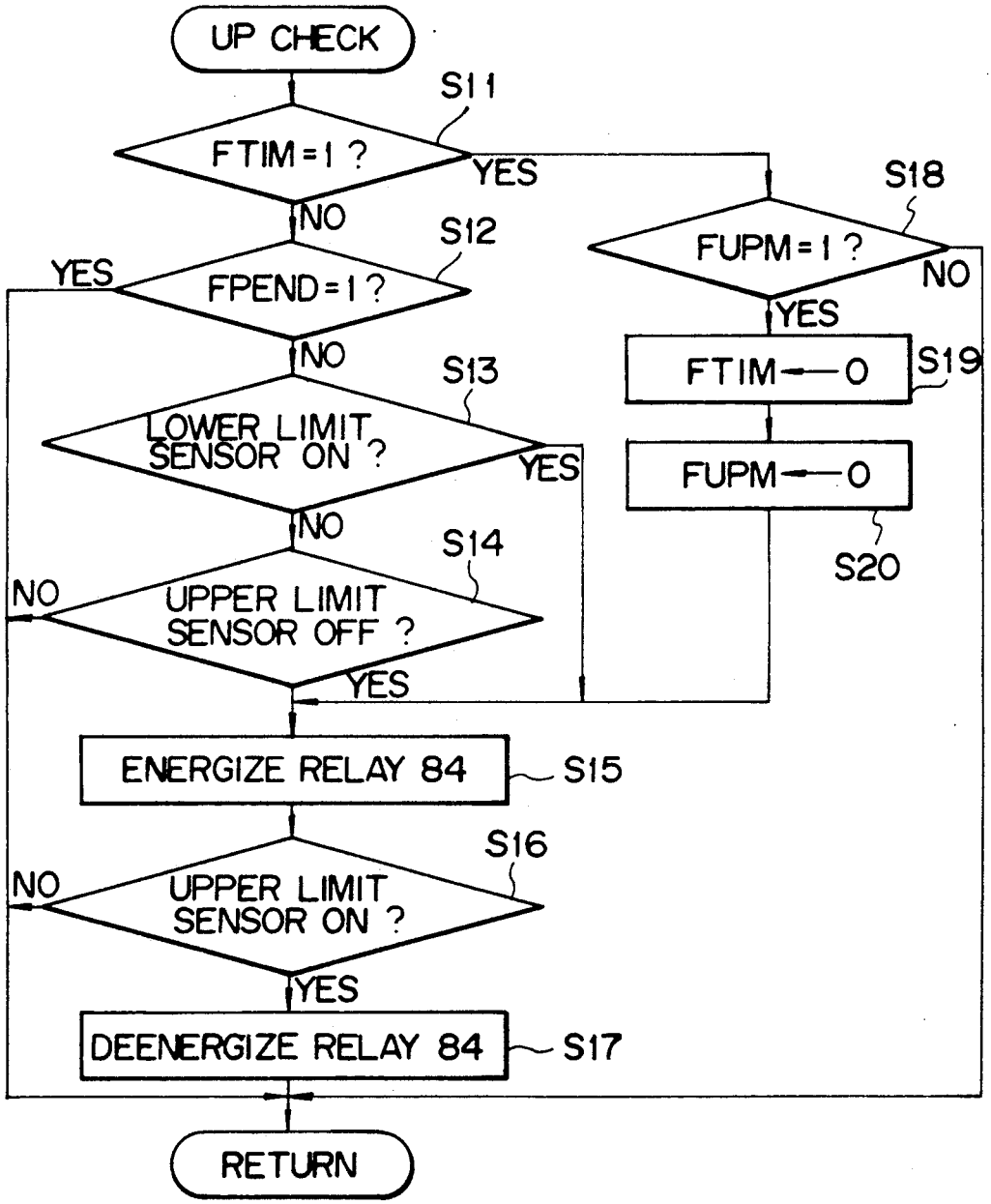

As FIG. 9 indicates, the up check subroutine (step S4, FIG. 8) begins with a step S11 for determining the status of the flag FTIM. Usually, the flag FTIM is (logical) "0" and, hence, the program advances to a step S12. In the step S12, the status of the flag FPEND is determined. Usually, the flag FPEND is "0", a step S13 is executed to see if the upper limit sensor 48 is in an ON state, i.e., if the tray 34 is held in the lower limit position thereof. If the answer of the step S13 is NO, the program advances to a step S14 while, if it is YES, the program advances to a step S15 by skipping the step S14. In the step S14, whether or not the upper limit sensor 72 is in an OFF state, i.e., whether or not the tray 34 is held in a position other than the upper limit position thereof is determined. If the answer of the step S14 is YES, the step S15 is executed to energize the solid-state relay 84. The step S15 is followed by a step S16 for determining whether or not the upper limit sensor 72 is in an ON state. If the answer of the step S16 is YES, meaning that the tray 34 is in the upper limit position, a step S17 is executed to deenergize the relay 84. By the procedure described so far, as the paper sheets are sequentially consumed (fed) until the top of the paper stack on the tray 34 has been lowered below an adequate paper feed level, the relay 84 is energized to drive the motor 42 in the forward direction resulting in the tray 34 being elevated. As soon as the top of the paper stack reaches the adequate level, i.e., when the upper limit position of the tray 34 is sensed, the relay 84 is deenergized to turn off the motor 42 and, as a result, the tray 34 is brought to a halt. It is to be noted that if the answer of the step S11 is YES, the controller 88 executes steps S18 to S20.

Figure 10:
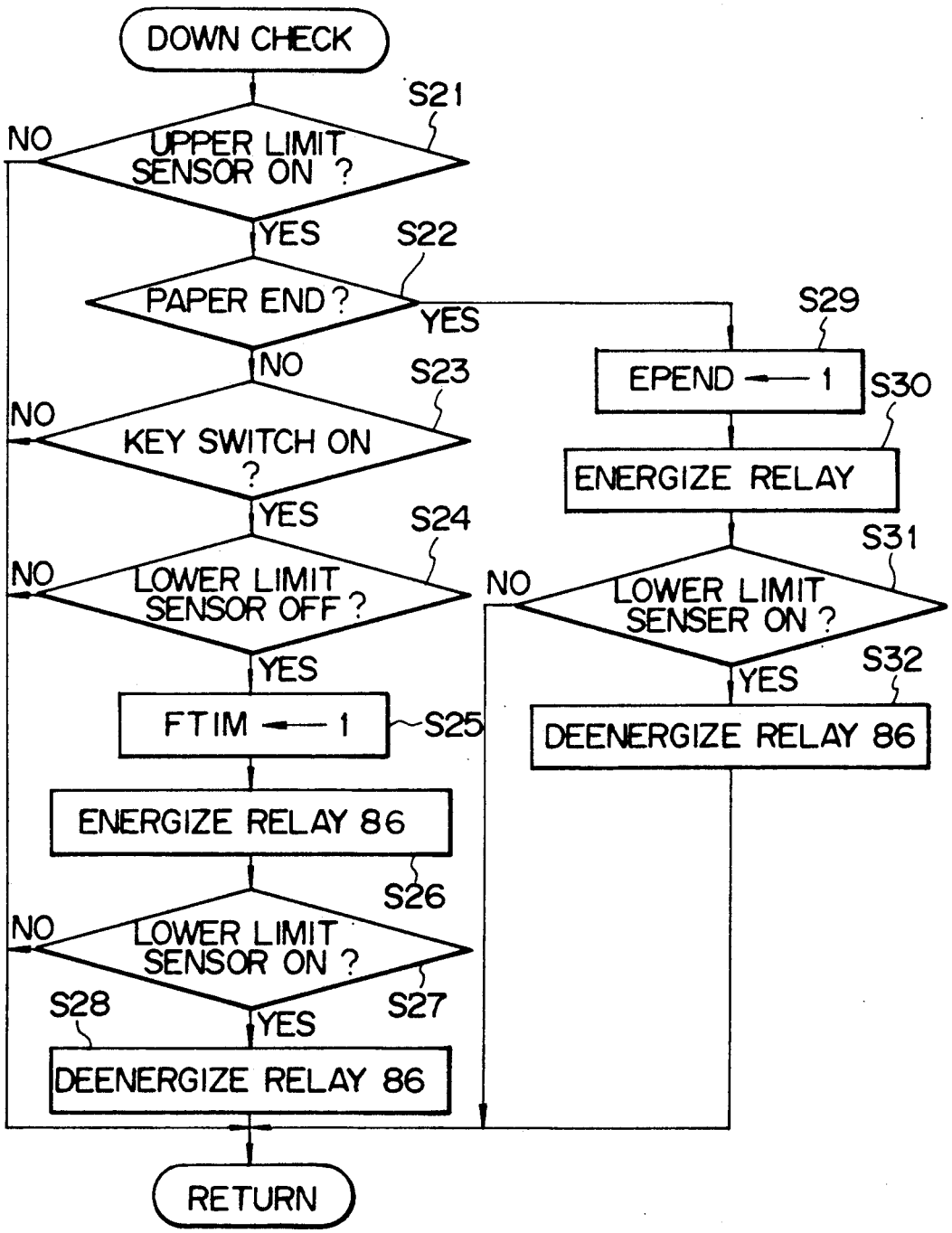

Referring to FIG. 10, the down check (step S6, FIG. 8) is shown. In a step S21, the controller 88 determines whether or not the upper limit sensor 72 is in an ON state, i.e., whether or not the tray 34 is in the upper limit position. If the answer of the step S21 is YES, the program advances to a step S22 for checking the status of a paper end sensor PS1 to see if no papers exist on the tray 34, i.e., if a paper end condition has occurred. If the answer of the step S22 is NO, a step S23 is executed to see the status of the key switch 90. Usually, when the operator turns on the key switch 90, the program advances to a step S26 by way of steps S24 and S25. In the step S25, the flag FTIM is set to (logical) "1", and in the step S26 the solid-state relay 86 is energized. In a step S27, the status of the lower limit position sensor 48 is determined. When the sensor 48 is in an ON state, a step S28 is executed to deenergize the relay 86. More specifically, when the operator manipulates the key switch 90 in order to see the remaining amount of paper sheets or to supply paper sheets, the motor 42 is reversed to lower the tray 34 down to the lower limit position and is denergized as the latter reaches the lower limit position. At the same time, the flag FTIM is set to "1".

Figure 11:
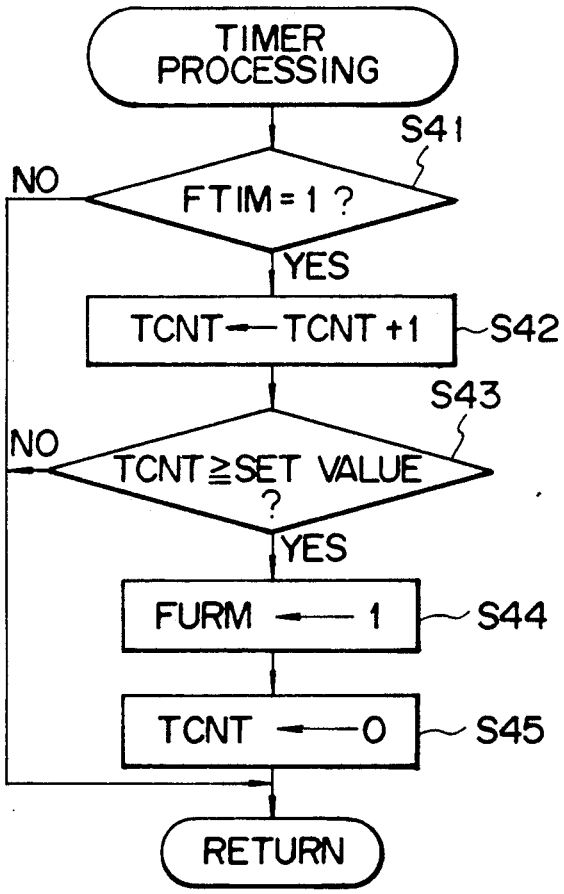

The timer processing shown in FIG. 11 begins with a step S41 for determining whether or not the flag FTIM has been set to "1" as mentioned above. If the answer of the step S41 is YES, the controller 88 enables the counter TCNT first and, thereafter, sequentially increments the counter TCNT every time this step is executed (step S42). As a predetermined period of time (e.g. 1 minute) expires after the turn-on of the key switch 90, whether or not the counter TCNT has reached a predetermined value is determined (step S43). If the answer of the step S43 is YES, the flag FUPM is set to "1" (step S44). Then, in a step S45, the counter TCNT cleared and disabled.

Referring again to FIG. 9, when the flag FUPM is set as determined in the step S18, the flag FTIM is cleared (step S19), and then the flag FUPM is cleared (step S20). This is followed by the step S15. When the step 15 is executed, the motor 42 is driven in the forward direction to start elevating the tray 34. As soon as the tray 34 reachs the upper limit position as determined in the step S16, the motor 42 is denergized (step S17) to bring the tray 34 to a halt. By such a procedure, when the tray 34 is lowered by the key switch 90 and left in such a position, it is automatically returned to the upper limit position on the lapse of a predetermined period of time.

Figure 12:
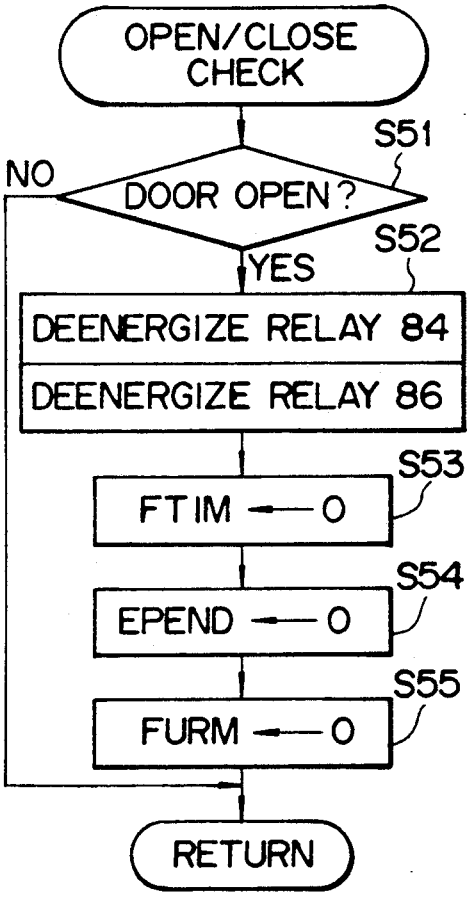

However, when the door 98 of the paper feeding device 22 is open as determined in a step S51 shown in FIG. 12, the controller 88 executes a step S52 to denergize the motor 42. In steps S53 to S55, the flags FTIM, FPEND and FUPM are cleared so that the tray 34 does not move. When a paper end condition is detected as determined in the step S22 of FIG. 10, the program advances to a step S29 and, hence, the step S25 is not executed. As a result, the tray 34 is inhibited from moving upward.

When the paper end condition is detected while the tray 34 is in the upper limit position (steps S21 and S22, FIG. 10), the flag FPEND is set (step S29), the relay 86 is energized (step S30), and whether or not the tray 34 has reached the lower limit position is determined (step S31). If the answer of the step S31 is YES, the relay 86 is deenergized (step S32). Consequently, the motor 42 is turned off to stop the movement of the tray 34. More specifically, when the tray 34 runs out of paper sheets, the tray 34 is automatically lowered to its lower limit position.

Figure 13:
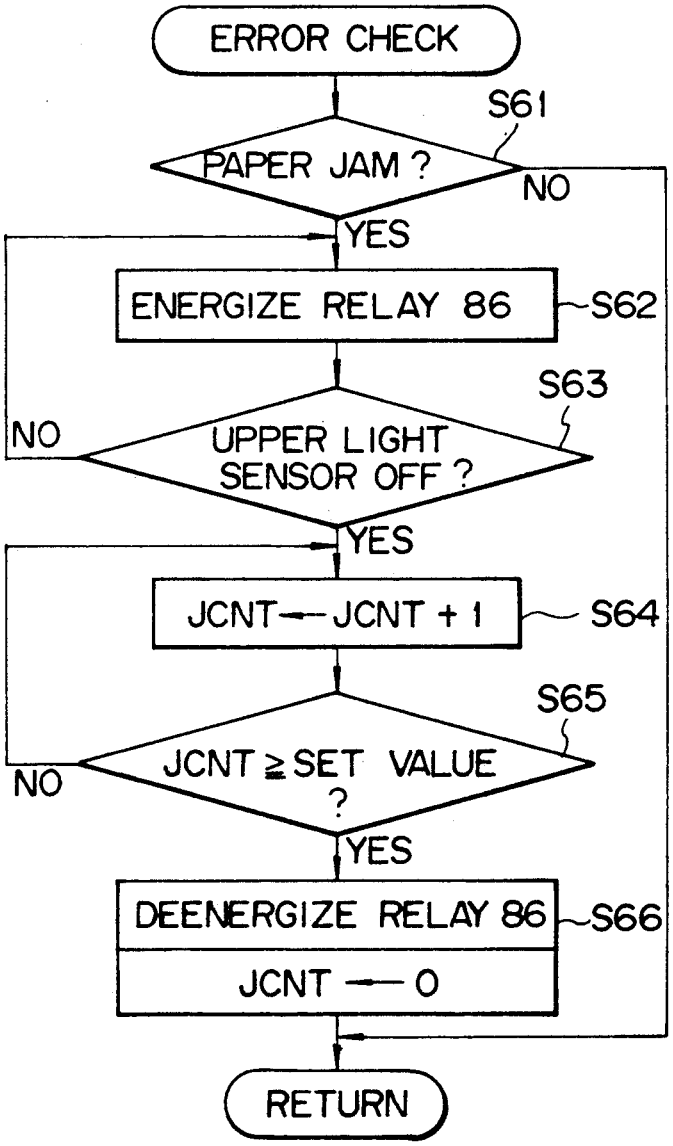

FIG. 13 shows the error check subroutine (S8, FIG. 8). As shown, when the copier body 10 informs the controller 88 of the occurrence of a paper jam as determined in a step S61, the relay 86 is energized to drive the motor 42 in the reverse direction and to thereby lower the tray 34 (step S62). When the upper limit sensor 72 stops sensing the upper limit position as determined in a step S63, the controller 88 sequentially increments the counter JCNT until the latter reaches a predetermined value (step S64). When the counter JCNT reaches the predetermined value, i.e., when a predetermined period of time expires after the movement of the tray 34 away from the upper limit position as determined in a step S65, the relay 86 is deenergized and the counter JCNT is cleared (step S66). More specifically, when a paper jam or similar error has occurred in the vicinity of the paper supply opening while paper feed is under way (with the tray 34 staying at the upper limit position), the tray 34 is lowered automatically. It is noteworthy that this downward displacement of the tray 34 is comparatively small, i.e., the tray 61 is lowered by only a predetermined stroke after the pressure acting between the sheets and the feed roller has been cancelled. In this case, the lowered position of the tray 61 intervenes between the upper and lower limit positions. Such a small displacement of the tray 34 is successful in forming a minimum necessary through space in front of the paper feed opening for allowing the operator to see the condition of the paper feed opening or to remove a jamming sheet. When the operator closes the door 98 after the removal of a jamming paper, for example, the tray 34 is elevated automatically by the processing shown in FIG. 9. Since the upward stroke, like the above-stated stated downward stroke, is comparatively short, the tray 34 reaches the upper limit position (adequate paper feed position) within a comparatively short period of time. The operator, therefore, can resume the paper feeding operation without waiting long.

In summary, in accordance with the present invention, when a paper jam or similar error occurs in the vicinity of a paper feed opening, a tray is lowered automatically. This cancels a paper feeding pressure and brings the tray to a stop at a position between its upper and lower limit positions, thereby forming a through space in front of the paper feed opening. Then, the operator can see and remove a jamming sheet through the space. At this instant, since the tray is located above the lower limit position, it will be restored to the upper limit position by a comparatively short stroke when elevated after the removal of the jamming sheet. This allows the operator to resume the paper feeding operation with a minimum of waiting time.

Various modifications will become possible for those skilled in the art after receiving the teachings of the present disclosure without departing from the scope thereof.

What is claimed is:

1. A device for sequentially feeding a number of paper sheets stacked on elevatable tray means one by one through a paper feed opening, comprising:

drive means for driving the tray means up and down;

paper feeding means for sequentially feeding the paper sheets stacked on the tray means through the paper feed opening;

upper limit position sensing means for sensing an upper limit position of the tray means corresponding to a position at which the paper sheets on said tray means are pressed by said paper feeding means;

lower limit position sensing means for sensing a lower limit position of the tray means;

control means for controlling, when an error is detected in the vicinity of the paper feed opening while the tray means is in said upper limit position, said drive means to lower said tray means by a predetermined stroke until said tray means reaches a first position intervening between said upper limit position and said lower limit position, wherein when the tray means is lowered to said first position intervening between said upper limit position and said lower limit position, a gap contiguous with said paper feed opening is formed, said gap having the minimum dimensions necessary for dealing with the error; and wherein, when a low paper signal is detected, said control means controls said drive means to lower said tray means by a predetermined stroke until said tray means reaches a second position intervening between said upper limit position and said lower limit position.

2. A device according to claim 1, wherein when a lower tray means command is detected said control means controls said drive means to lower said tray means to said lower limit position.

* * * * *